US009453367B1

(12) United States Patent
Plummer

(10) Patent No.: US 9,453,367 B1
(45) Date of Patent: Sep. 27, 2016

(54) DIMENSIONALLY ADJUSTABLE THERMALLY BROKEN DOOR PANEL

(71) Applicant: GLASSCRAFT DOOR COMPANY, Houston, TX (US)

(72) Inventor: John B. Plummer, Houston, TX (US)

(73) Assignee: GLASSCRAFT DOOR COMPANY, Houston, TX (US)

( * ) Notice: Subject to any disclaimer, the term of this patent is extended or adjusted under 35 U.S.C. 154(b) by 0 days.

(21) Appl. No.: 14/951,113

(22) Filed: Nov. 24, 2015

(51) Int. Cl.

| | |
|---|---|
| ***E06B 3/82*** | (2006.01) |
| ***E06B 3/76*** | (2006.01) |
| ***E06B 3/72*** | (2006.01) |
| ***E06B 3/70*** | (2006.01) |
| ***E06B 3/78*** | (2006.01) |

(52) U.S. Cl.
CPC ..... *E06B 3/725* (2013.01); *E06B 3/70* (2013.01); *E06B 3/76* (2013.01); *E06B 3/78* (2013.01); *E06B 3/822* (2013.01); *E06B 3/825* (2013.01); *E06B 3/827* (2013.01)

(58) Field of Classification Search
CPC ..... E06B 3/725; E06B 3/78; E06B 3/70; E06B 3/76; E06B 3/7023; E06B 3/822; E06B 2003/7063; E06B 1/20; E06B 1/98; E06B 3/827; E06B 3/825
See application file for complete search history.

(56) References Cited

U.S. PATENT DOCUMENTS

| | | | | |
|---|---|---|---|---|
| 2,839,792 | A * | 6/1958 | Sanders | E06B 3/825 403/291 |
| 3,750,358 | A | 8/1973 | Lewkowitz | |
| 3,760,543 | A | 9/1973 | McAllister | |
| 3,903,669 | A | 9/1975 | Pease, Jr. et al. | |
| 4,021,967 | A | 5/1977 | Mulder et al. | |
| 4,068,431 | A * | 1/1978 | Pitt | E06B 3/78 52/455 |
| 4,114,319 | A * | 9/1978 | Governale | E06B 3/82 428/122 |
| 4,148,157 | A * | 4/1979 | Franc | E06B 3/822 49/501 |
| 4,152,876 | A * | 5/1979 | Seely | E06B 3/825 49/503 |
| 4,246,731 | A | 1/1981 | Miro | |
| 4,374,693 | A * | 2/1983 | Pitt | E06B 3/5892 156/267 |
| 4,720,951 | A | 1/1988 | Thorn et al. | |
| 4,735,025 | A | 4/1988 | Day | |
| 4,920,718 | A | 5/1990 | Artwick et al. | |
| 4,945,680 | A * | 8/1990 | Giguere | E06B 7/2316 49/467 |
| 5,074,087 | A * | 12/1991 | Green | E06B 3/7001 52/309.9 |
| 5,133,168 | A | 7/1992 | Neilly et al. | |
| 5,249,403 | A | 10/1993 | Neilly et al. | |
| 5,570,548 | A | 11/1996 | Hopper | |
| 5,634,508 | A | 6/1997 | Herbst | |

(Continued)

*Primary Examiner* — Charles A Fox
*Assistant Examiner* — Charissa Ahmad
(74) *Attorney, Agent, or Firm* — Buskop Law Group, PC; Wendy Buskop

(57) ABSTRACT

A dimensionally adjustable thermally broken door panel having a door thickness, a first and second thermally conductive metal door skins and a plurality of non-thermally conductive trimable edges. Each trimable edge having an edge flange, a door edge and an edge flange thickness. An insert flange can be integrally mounted each of the edge flanges projecting in a direction opposite the door edge, wherein each edge flange can support both the first and second thermally conductive metal door skins in a flush engagement. The dimensionally adjustable thermally broken door panel can prevent thermal transfer between the first and second metal door skins, while enabling dimensional adjustment of the plurality of trimable edges on location to ensure a perfect fit into an existing door frame.

12 Claims, 3 Drawing Sheets

(56) References Cited

U.S. PATENT DOCUMENTS

| | | | | |
|---|---|---|---|---|
| 5,644,881 | A | 7/1997 | Neilly | |
| 5,775,041 | A * | 7/1998 | Tull | E06B 3/10 403/231 |
| 5,894,706 | A | 4/1999 | Herbst | |
| 6,185,894 | B1 * | 2/2001 | Sisco | E06B 3/725 52/455 |
| 6,272,801 | B1 | 8/2001 | Suh | |
| 6,497,938 | B1 * | 12/2002 | Hill | B32B 21/06 428/131 |
| 6,574,935 | B2 | 6/2003 | Wang et al. | |
| 6,694,701 | B2 | 2/2004 | Wang et al. | |
| 6,925,767 | B2 | 8/2005 | Krochmal et al. | |
| 7,448,174 | B2 | 11/2008 | Krochmal et al. | |
| D613,878 | S | 4/2010 | Walsh et al. | |
| 7,765,768 | B2 * | 8/2010 | Liang | B27N 5/00 428/106 |
| D625,838 | S | 10/2010 | Walsh et al. | |
| 8,449,946 | B2 | 5/2013 | Kurth et al. | |
| 8,845,847 | B1 | 9/2014 | Plummer et al. | |
| 8,984,821 | B2 * | 3/2015 | Bruno | E06B 3/72 52/210 |
| 9,085,928 | B2 * | 7/2015 | Yeremian | E06B 5/11 |
| 2003/0041539 | A1 | 3/2003 | Bernacki et al. | |
| 2003/0056442 | A1 | 3/2003 | Gerard | |
| 2005/0210797 | A1 * | 9/2005 | Hees | E06B 3/725 52/455 |
| 2010/0064625 | A1 | 3/2010 | Charlton et al. | |
| 2010/0279101 | A1 | 11/2010 | Cageao et al. | |
| 2010/0310823 | A1 | 12/2010 | Albertelli et al. | |
| 2011/0061322 | A1 | 3/2011 | Wang Chen | |
| 2011/0214356 | A1 * | 9/2011 | Kashani | E06B 3/78 49/506 |
| 2015/0233133 | A1 * | 8/2015 | Ajrab | E06B 3/70 49/506 |

* cited by examiner 10
11
30
150
50
92
88
77
70
62
40a
73
64
72
60
20
74

DIMENSIONALLY ADJUSTABLE THERMALLY BROKEN DOOR PANEL

FIELD

The present embodiments generally relate to a thermally broken door panel that is trimable in the field ensuring a perfect fit into an existing door frame.

BACKGROUND

A need exists for a thermally stable dimensionally adjustable thermally broken door panel.

The present embodiments meet these needs.

BRIEF DESCRIPTION OF THE DRAWINGS

The detailed description will be better understood in conjunction with the accompanying drawings as follows.

Figure 1A:
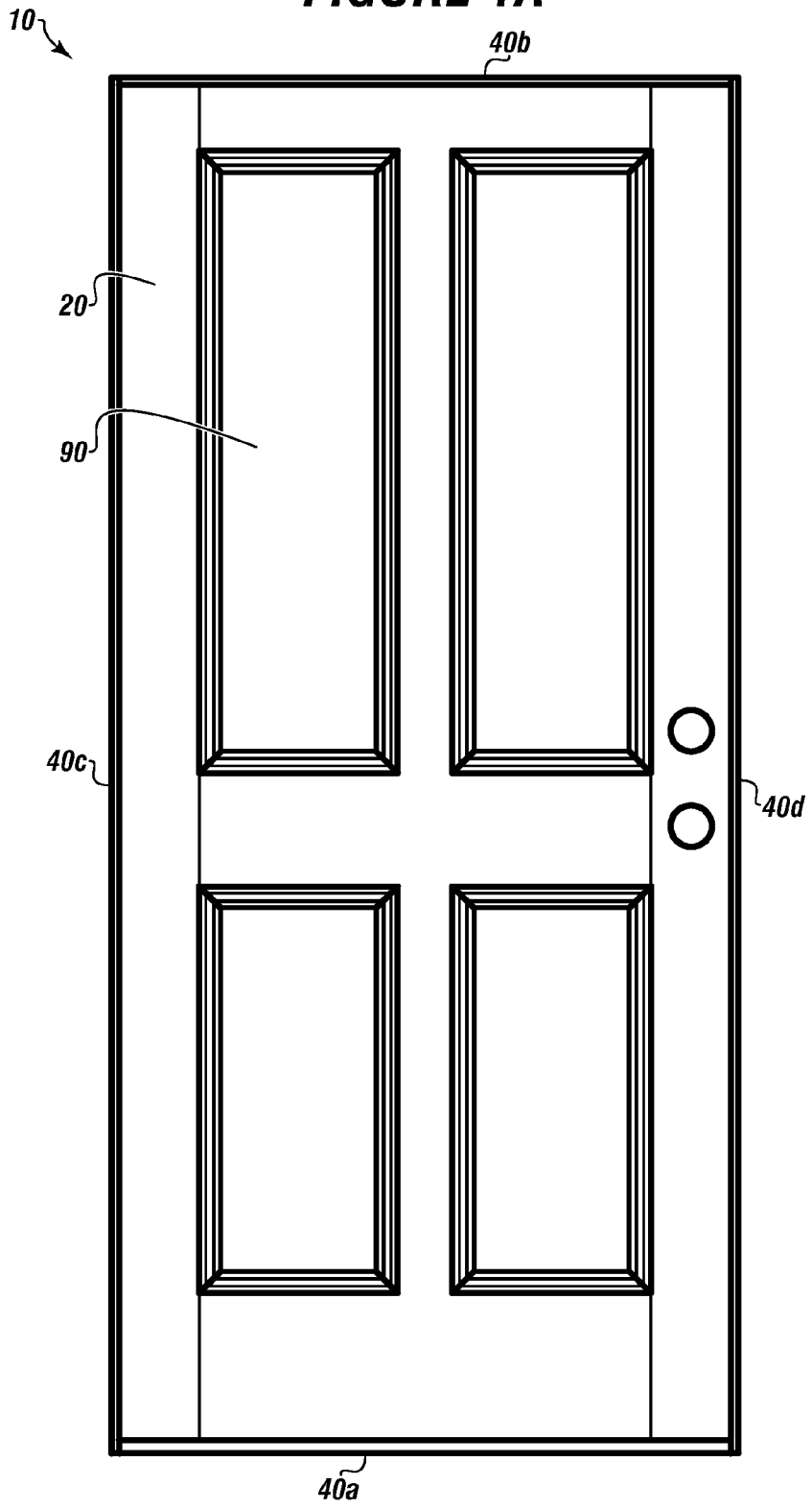
FIG. 1A is a front view of a dimensionally adjustable thermally broken door panel according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The current embodiments relate to a dimensionally adjustable thermally broken door panel having a door thickness, a first thermally conductive metal door skin, a second thermally conductive metal door skin, and a plurality of non-thermally conductive trimable edges.

Each non-thermally conductive trimable edge can have an edge flange, a door edge and an edge flange thickness, which can be identical to the door thickness.

In embodiments, each non-thermally conductive trimable edge can have an insert flange, which can be integrally mounted to the edge flange projecting in a direction opposite the door edge.

The insert flange can extend into an internal structural door component. In embodiments, the insert flange can have a thickness at least 5 percent to 60 percent less than the door thickness.

Each edge flange can support the first thermally conductive metal door skin and the second thermally conductive metal door skin in a flush engagement.

The dimensionally adjustable thermally broken door panel can prevent thermal transfer, which is a flow of thermal energy between the first and second metal door skins, while simultaneously enabling dimensional adjustment of the plurality of trimable edges on location to ensure a perfect fit into an existing door frame.

The dimensionally adjustable thermally broken door panel can be a metal door panel that prevents transfer of heat from the exterior of the door panel to the interior of the door panel.

The embodiments can further relate to a door panel to prevent ice build-up on the inside of the door panel during cold weather. For example, this embodiment can prevent ¼ of an inch of ice from building up on the interior door face on the inside of a house.

The dimensionally adjustable thermally broken door panel can save on energy costs.

The dimensionally adjustable thermally broken door panel can be energy saving can assist people, who are on a fixed budget, with paying their energy bills at a lower cost.

The dimensionally adjustable thermally broken door panel can provide additional security in the home due to the thickness of the steel of the door skins.

The dimensionally adjustable thermally broken door panel can withstand impacts from a category 1 hurricane without deforming, preventing injury or even death in the home due to flying projectiles when the door blows in. Additionally the dimensionally adjustable thermally broken door panel door can prevent the pressure differential caused when a door blows in and prevent roofs from coming off the house.

In embodiments, the dimensionally adjustable thermally broken door panel can be at least 1.75 inches thick. The thickness can be an advantage as no special hardware is needed on the door panel.

In embodiments, the dimensionally adjustable thermally broken door panel can be installed in an existing door frame and does not require the tearing out of the front of the house and rebuilding to install the door panel. This invention can allow the door frame to be trimmed for install, which can save at least $1000 in labor and material costs per door.

The final dimensionally adjustable thermally broken door panel can have a height ranging from 70 inches to 100 inches, a width ranging from 24 inches to 48 inches, and a thickness ranging from 1.75 inches to 2.24 inches.

The term "door panel" as used herein can refer to an exterior door panel, such as those for newly constructed houses, commercial buildings, and institutions, such as assisted care institutions, schools, and hospitals.

The term "door edge" as used herein can refer to a surface of a trimable edge that forms the edge of the final dimensionally adjustable thermally broken door panel. Generally the door edge is an outer surface of the trimable edge.

The term "door skin" as used herein can refer to a flexible metal plate that forms the visible front face and back face of a door panel (interior side and exterior side). The door skin can be as thin as 0.02 inches to as thick as 0.08 inches. The door skin can be a continuous material, which can be perforated by a door light or a "speak easy" door opening. In embodiments, the door skin can be a laminate of two layers.

The term "metal" as used herein can refer to the material of the visible door faces which are predominately, stainless steel, aluminum, cold rolled steel, hot rolled steel, a bi-metal comprising two metals of different properties.

The term "edge flange" as used herein can refer to the portion of each thermally non-conductive trimable edge that not only supports the door skins but simultaneously is shapeable and trimmed to fit a unique frame.

The term "edge flange thickness" as used herein can refer to the dimension of the trimable edge between a door panel front and a door panel back, which can include the thickness of both thermally conductive metal door skins.

The term "flush engagement" as used herein can refer to a friction fit, wherein a portion of the edge flange is smooth without projecting outwardly, forming a continuous plane with both outer surfaces of the thermally conductive metal door skins.

The term "insert flange" as used herein can refer to a projection that extends into the internal structural door component and is between the first and second thermally conductive metal door skins. It can have a thickness ranging from 0.7 inches to 1.25 inches and extend the entire width of the formed dimensionally adjustable thermally broken door panel. In embodiments, the thickness and height of the insert flange can be larger or smaller than these ranges, as long as the thickness is at least 5 percent to 60 percent less than the door thickness. In embodiments, the insert flange can be centrally located in the internal structural door component. In embodiments, the insert flange can be a one piece component. In embodiments, the insert flange might not be a one piece component and could contain a plurality of extensions that project into the internal structural door component providing a more snug fit, which can prevent deformation in the face of Category 4 hurricane winds.

The term "internal structural door component" as used herein can refer to a support material that is generally rigid and has a thickness wider than the insert flange but less than the thickness of the formed dimensionally adjustable thermally broken door panel. In embodiments, the internal structural door component can be made from wood timber, composite of a non-formaldehyde based resin and aspen formed under pressure and temperature. In embodiments, the internal structural door component can be made from steel reinforced polymer. In embodiments, the internal structural door component can be made from an extruded polyvinyl chloride (PVC). A laminated veneer lumber is also usable as the internal structural door.

The term "non-thermally conductive" as used herein with the noun "trimable edges" can refer to a material that does not easily transfer heat energy across a thickness of the trimable edge from an exterior ambient heat source to an interior air space. For example, a usable non-thermally conductive trimable edge can be made from a dense polyurethane foam, an extruded polymer, such as an extruded polyester, a cast glass filled fiberglass, or a wood, which is either in its natural state or reformed composite wood product.

The term "thermally broken door profile" as used herein can refer to a design of a door panel where heat does not transfer between a first thermally conductive metal door skin and a second thermally conductive metal door skin.

The term "trimable edge" as used herein can refer to a component that can be cut, such as with a saw, planed with a plane, sanded with a sander to form an edge with a unique custom shape that can fit precisely within a preexisting door frame or a newly mounted door frame.

Turning now to the Figures, FIG. 1A is a front view of a dimensionally adjustable thermally broken door panel according to one or more embodiments.

The dimensionally adjustable thermally broken door panel 10 can have a first thermally conductive metal door skin 20, a second thermally conductive metal door skin 30 (shown in FIG. 2), and a plurality of non-thermally conductive trimable edges 40*a*, 40*b*, 40*c* and 40*d*.

A panel design 90 can be stamped into the first thermally conductive metal door skin, the second thermally conductive metal door skin, or both the first thermally conductive metal door skin and the second thermally conductive metal door skin.

The plurality of non-thermally conductive trimable edges 40*a*-40*d* can be connected together to form a frame support structure.

Figure 1B:
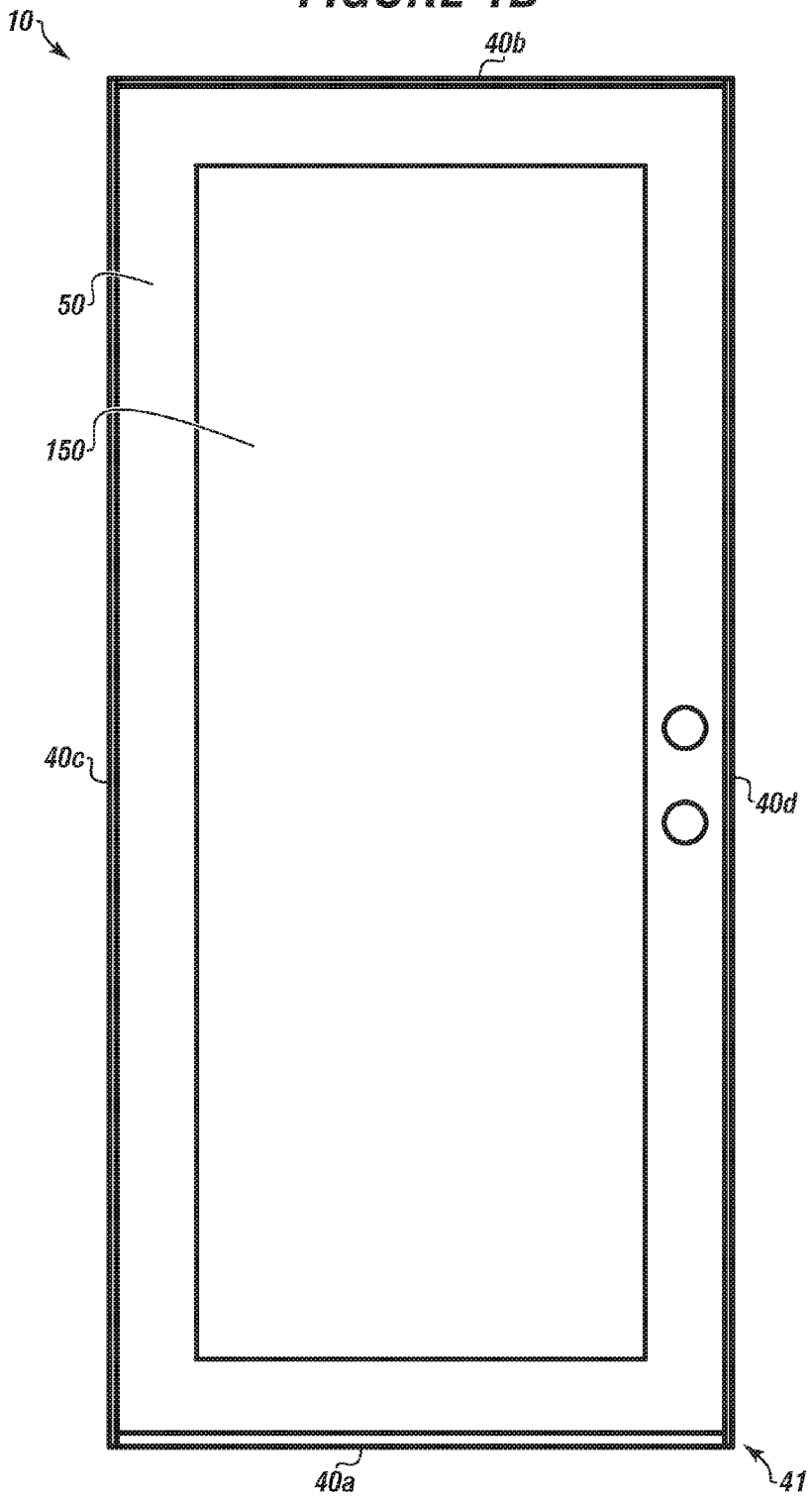
FIG. 1B is a perspective view of a frame support structure of the dimensionally adjustable thermally broken door panel according to one or more embodiments.

FIG. 1B is a perspective view of a frame support structure of the dimensionally adjustable thermally broken door panel according to one or more embodiments.

The frame support structure 41 can include an internal structural door component 50, which can be mounted between: (i) the first thermally conductive metal door skin, (ii) the second thermally conductive metal door skin and (iii) the plurality of non-thermally conductive trimable edges 40*a*-40*d*, wherein these components can be mounted simultaneously.

Each non-thermally conductive trimable edge 40*a*-40*d* can be partially contained within the first and second thermally conductive metal door skins, creating a flush engagement.

The plurality of non-thermally conductive trimable edges can fit neatly between the first thermally conductive metal door skin and the second thermally conductive metal door skin.

Figure 2:
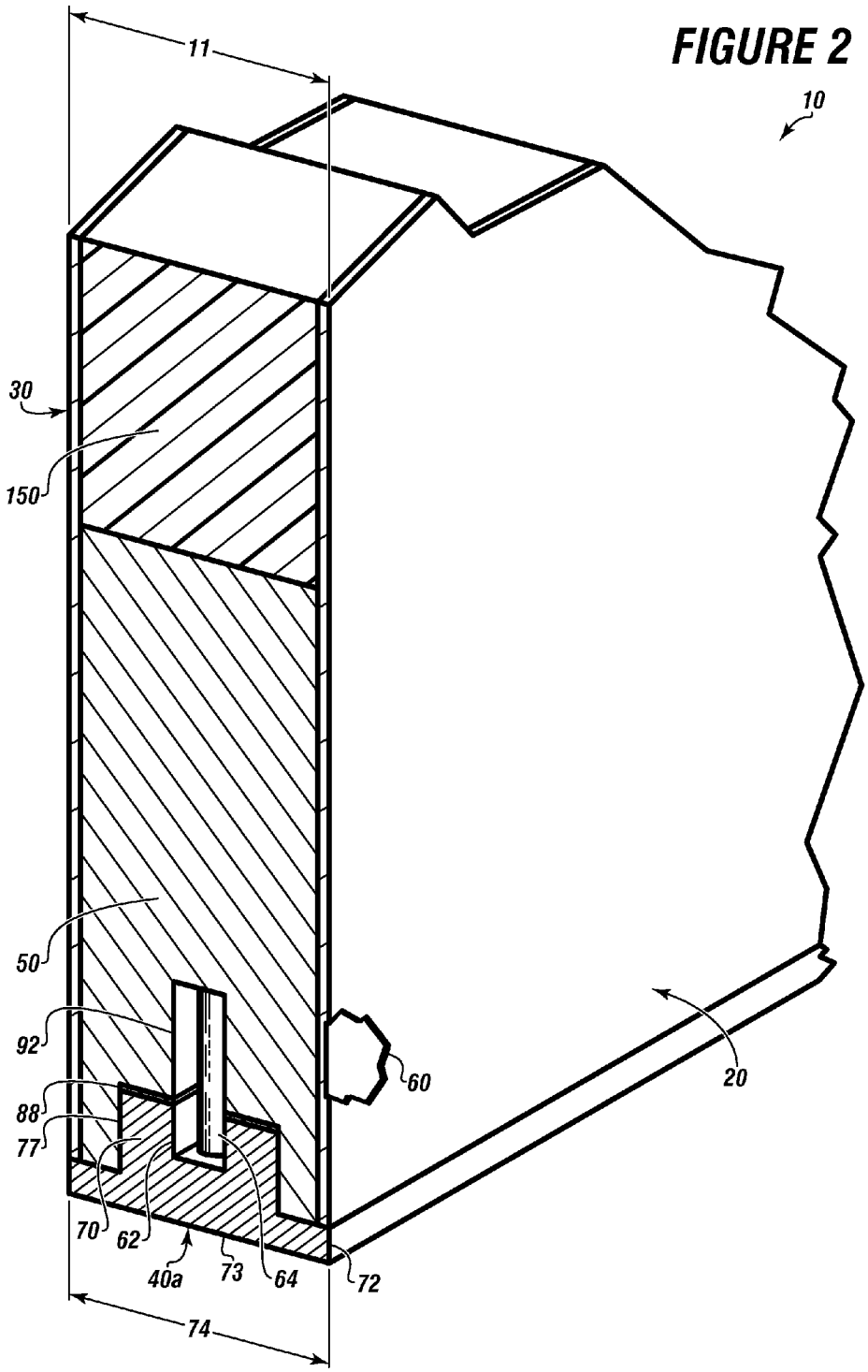
FIG. 2 is a view of a portion of the dimensionally adjustable thermally broken door panel according to one or more embodiments.

FIG. 2 is a view of a portion of the dimensionally adjustable thermally broken door panel according to one or more embodiments.

The dimensionally adjustable thermally broken door panel 10 is shown with the first thermally conductive metal door skin 20 and a second thermally conductive metal door skin 30. One trimable edge 40*a* of the plurality of non-thermally conductive trimable edges is shown positioned between the first and second thermally conductive metal door skins.

The dimensionally adjustable thermally broken door panel 10 is depicted with a door thickness 11.

The internal structural door component 50 can be mounted to the plurality of non-thermally conductive trimable edges while being contained between the first and second thermally conductive metal door skins forming the frame support structure.

In embodiments, the internal structural door component 50 can have a door core 150. The door core 150 can be but is not limited to: air, polyurethane foam, a biofoam, and combinations thereof with a density from 1.5 pounds per cubic foot to 10 pounds per cubic foot. In other embodiments, the door core 150 can be STYROFOAM® or a wood panel.

A fastener channel 92 can be centrally formed in the internal structural door component 50, wherein a fastener can be inserted within the fastener channel 92 for mating the internal structural door component 50 to at least one non-thermally conductive trimable edge.

Each non-thermally conductive trimable edge can have an edge flange 72 with a door edge 73 and an edge flange thickness 74, which can be identical to the door thickness 11.

Each of the plurality of non-thermally conductive trimable edges can have an insert flange 70, which can be integrally mounted to the edge flange 72 for inserting in a flange channel 77 in the internal structural door component 50.

The insert flange 70 can project into the flange channel 77 in a direction opposite the door edge 73.

The insert flange can have a thickness at least 5 percent to 60 percent less than the door thickness 11.

Each edge flange can support both the first and second thermally conductive metal door skins in a flush engagement.

In embodiments, an adhesive 88 can be installed in the flange channel 77 to engage the insert flange 70.

The non-thermally conductive trimable edge can have an assembly groove 62, which can extend longitudinally the length of the non-thermally conductive trimable edge.

At least one fastener 64 can be mounted in the assembly groove 62. The at least one fastener can connect the internal structural door component 50 to the non-thermally conductive trimable edge 40*a*. In embodiments, the least one fastener can be a Christmas tree fastener, a screw, a nut and bolt assembly and a peg.

In embodiments, a finish coat 60 is disposed over the first thermally conductive metal door skin 20.

In embodiments, the finish coat can be a paint.

In embodiments, the dimensionally adjustable thermally broken door panel can have a thermally broken door profile covering all of the dimensionally adjustable thermally broken door panel, which can prevent thermal conductivity for energy dissipated as heat, thereby by preventing a flow of thermal energy between the first thermally conductive metal door skin and the second thermally conductive metal door skin to prevent thermal bridging between the first thermally conductive metal door skin and the second thermally conductive metal door skin while simultaneously enabling dimensional adjustment of the plurality of non-thermally conductive trimable edges on location to ensure a perfect fit into an existing door frame.

In embodiments, the non-thermally conductive trimable edges can be made from sawdust and post-consumer material, such as water bottles. Post-consumer material can refer to waste material generated by households or by commercial, industrial and institutional facilities in their role as end-users of the product, which can no longer be used for its intended purpose.

In embodiments, the dimensionally adjustable thermally broken door panel can have one non-thermally conductive trimable edge that can a thickness from at least 1 to 8 times larger than the other non-thermally conductive trimable edges.

In embodiments, the dimensionally adjustable thermally broken door panel can have a plurality of non-thermally conductive trimable edges, wherein each non-thermally conductive trimable edge can be made up of an edge flange, which can be integrally connected to the insert flange.

In embodiments, the insert flange can have height from 100 percent to 200 percent of a height of the edge flange and a width from 25 percent to 70 percent of the width of the edge flange.

In embodiments, the dimensionally adjustable thermally broken door panel can use a metal, such as steel, aluminum, or a bimetal.

In embodiments, the dimensionally adjustable thermally broken door panel can use from 16 gauge plates of metal to 20 gauge plates of metal for the first thermally conductive metal door skin and the second thermally conductive metal door skin.

While these embodiments have been described with emphasis on the embodiments, it should be understood that within the scope of the appended claims, the embodiments might be practiced other than as specifically described herein.

What is claimed is:

1. A dimensionally adjustable thermally broken door panel having a door thickness, the dimensionally adjustable thermally broken door panel consisting of:

a. a first thermally conductive metal door skin;

b. a second thermally conductive metal door skin;

c. a plurality of non-thermally conductive trimable edges, each non-thermally conductive trimable edge partially contained within the first thermally conductive metal door skin and the second thermally conductive metal door skin, each non-thermally conductive trimable edge comprising:

i. an edge flange comprising:

1. a door edge; and 2. an edge flange thickness identical to the door thickness; and ii. an insert flange integrally mounted to the edge flange, the insert flange projecting in a direction opposite the door edge, the insert flange having a thickness at least 5 percent to 60 percent less than the door thickness; and wherein the edge flange supports both the first thermally conductive metal door skin and the second thermally conductive metal door skin in a flush engagement; and d. an internal structural door component comprising a door core and a flange channel for receiving the insert flange from at least one of the plurality of non-thermally conductive trimable edges, the internal structural door component being contained between the first thermally conductive metal door skin and the second thermally conductive metal door skin forming a frame support structure; and wherein the dimensionally adjustable thermally broken door panel prevents thermal transfer which is a flow of thermal energy between the first thermally conductive metal door skin and the second thermally conductive metal door skin, while simultaneously enabling dimensional adjustment of the plurality of non-thermally conductive trimable edges on location to ensure a perfect fit into an existing door frame.

2. The dimensionally adjustable thermally broken door panel of claim 1, each non-thermally conductive trimable edge having an assembly groove extending longitudinally the length of the non-thermally conductive trimable edge, and at least one fastener mounted in each assembly groove connecting the internal structural door component to the non-thermally conductive trimable edge.

3. The dimensionally adjustable thermally broken door panel of claim 1, wherein the internal structural door panel component comprises at least one of: a wood timber, a composite of a non-formaldehyde based resin and aspen formed under pressure and temperature, a steel reinforced polymer, an extruded polyvinyl chloride (PVC) and a laminated veneer lumber, sawdust and post-consumer material.

4. The dimensionally adjustable thermally broken door panel of claim 1, wherein at least one edge flange has a thickness at least 1 time to 8 times larger than another edge flange.

5. The dimensionally adjustable thermally broken door panel of claim 1, wherein the plurality of non-thermally conductive trimable edges comprise: an insert flange with a height from 100 percent to 200 percent larger than a height of the edge flange and a thickness from 25 percent to 70 percent less than a thickness of a connected edge flange.

6. The dimensionally adjustable thermally broken door panel of claim 5, comprising a fastener channel centrally formed in the internal structural door component, wherein at least one fastener is inserted within the fastener channel.

7. The dimensionally adjustable thermally broken door panel of claim 1, comprising an adhesive installed in the flange channel to engage the insert flange.

8. The dimensionally adjustable thermally broken door panel of claim 1, wherein the at least one fastener is a member of the group consisting of: a Christmas tree fastener, a screw, a nut and bolt assembly and a peg.

9. The dimensionally adjustable thermally broken door panel of claim 1, wherein the first thermally conductive metal door skin and the second thermally conductive metal door skin are 16 gauge plates of metal to 20 gauge plates of metal.

10. The dimensionally adjustable thermally broken door panel of claim 1, comprising a panel design stamped into at least one of: the first thermally conductive metal door skin and the second thermally conductive metal door skin.

11. The dimensionally adjustable thermally broken door panel of claim 1, comprising a finish coat disposed over the first thermally conductive metal door skin and the second thermally conductive metal door skin and the plurality of non-thermally conductive trimable edges.

12. The dimensionally adjustable thermally broken door panel of claim 11, wherein the finish coat is paint.

* * * * *